US007148438B2

(12) United States Patent
Magrini

(10) Patent No.: US 7,148,438 B2
(45) Date of Patent: Dec. 12, 2006

(54) TOGGLE ACTION LEVER

(75) Inventor: Sergio Magrini, Modena (IT)

(73) Assignee: CNH America LLC, Racine, WI (US)

( * ) Notice: Subject to any disclaimer, the term of this patent is extended or adjusted under 35 U.S.C. 154(b) by 0 days.

(21) Appl. No.: 11/069,289

(22) Filed: Mar. 1, 2005

(65) Prior Publication Data

US 2005/0194242 A1 Sep. 8, 2005

(30) Foreign Application Priority Data

Mar. 2, 2004 (IT) ..... TO2004A0131

(51) Int. Cl.
*H01H 3/04* (2006.01)
*H01H 3/20* (2006.01)

(52) U.S. Cl. ..... 200/335; 200/6 C; 200/402; 200/332; 74/473.3; 74/491; 74/502.2

(58) Field of Classification Search ..... 200/335, 200/461, 449, 463, 468, 402, 61.27, 6 BB, 200/6 C, 1 A, 409, 467, 458, 332; 74/523, 74/524, 501.6, 502, 502.2, 532, 473, 473.3, 74/473.21, 473.28, 491; 267/266, 160
See application file for complete search history.

(56) References Cited

U.S. PATENT DOCUMENTS

| | | | | |
|---|---|---|---|---|
| 1,885,246 | A * | 11/1932 | Forman | 200/457 |
| 3,218,054 | A * | 11/1965 | Nallinger | 267/266 |
| 3,591,740 | A * | 7/1971 | Kolster | 200/61.27 |
| 6,040,543 | A * | 3/2000 | Mina et al. | 200/559 |
| 6,791,047 | B1 * | 9/2004 | Skarlupka et al. | 200/335 |
| 6,943,310 | B1 * | 9/2005 | Eisenhower | 200/339 |

* cited by examiner

*Primary Examiner*—Elvin Enad
*Assistant Examiner*—Lheiren Mae A. Anglo
(74) *Attorney, Agent, or Firm*—Rebecca Henkel

(57) ABSTRACT

A lever mounted on a support for pivotal movement between two end positions is acted upon by a toggle spring connected at its opposite ends to the lever and the support to bias the lever away from a centre position of unstable equilibrium towards its two end positions. In the invention, instead of using a conventional coil spring, the toggle spring is constructed a leaf spring.

3 Claims, 1 Drawing Sheet

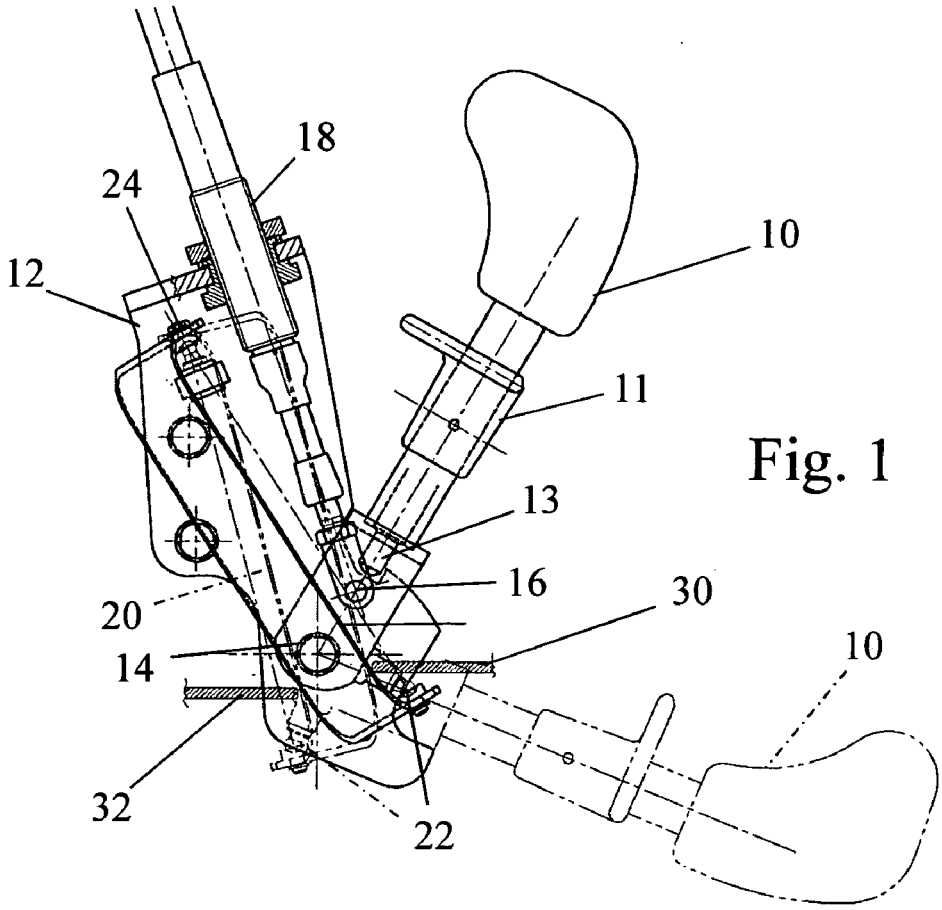
Fig. 1
Fig. 2
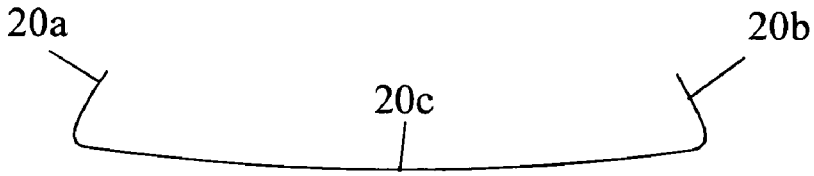
Fig. 3
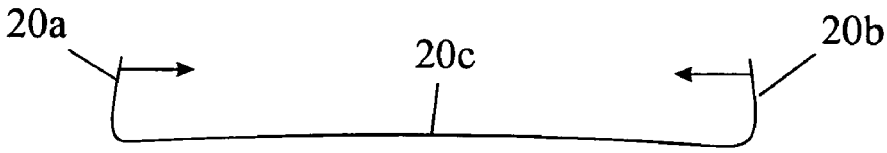
Fig. 4
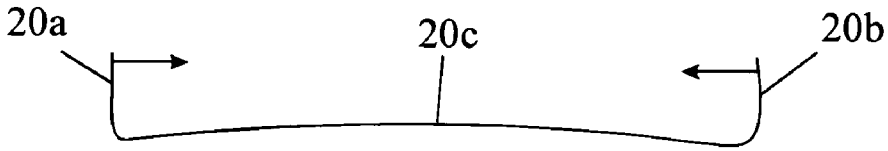

TOGGLE ACTION LEVER

FIELD OF INVENTION

The present invention relates to a toggle action lever, that is to say a lever with two stable end positions which passes through a centre position of unstable equilibrium while being moved from one end position to the other.

BACKGROUND OF THE INVENTION

There are many occasions when a control lever is required to have a two position toggle action, so that a function controlled by the lever can either be ON or OFF. A conventional manner in which this is achieved is to connect a coil spring to the lever and to the support bracket on which the lever is pivoted. The positions of the anchoring points of the ends of the spring are selected in such a manner that the distance between them increases and then decreases as the lever is moved from one end position to the other, to provide the desired toggle action.

A problem is encountered in the prior art in that on certain occasions there is not sufficient space to accommodate a coil spring. In particular, when the lever is short, the spring must have a sufficiently large diameter to exert a sufficient force on the lever. The difficulty in accommodating a spring of large diameter is aggravated by the need to keep the entire volume swept by the coil spring while moving from one position to the other free of any obstruction.

Other known solutions, such as providing a spring biased cam follower mechanism to act between the lever and its support also require additional space to accommodate them and need additional components which add to the complexity and cost.

SUMMARY OF INVENTION

With a view to mitigating the foregoing disadvantages, the present invention provides a lever mounted on a support for pivotal movement between two end positions and a toggle spring connected at its opposite ends to the lever and the support and acting to bias the lever away from a centre position of unstable equilibrium towards the two end positions, characterised in that the toggle spring is a leaf spring.

It will be appreciated that the term "centre" should not be taken to imply that the position of unstable equilibrium must be exactly midway between the two end positions.

Preferably, the leaf spring has two end portions for coupling the leaf spring to anchoring points on the lever and the support, respectively, and a central portion extending between the two end portions, the central portion of the leaf spring having a length substantially equal to the distance between the anchoring points. In this case, when it is deployed, the spring is essential straight, thereby minimising the space that it occupies.

It is further preferred for the end portions of the spring to be coupled to the anchoring points in such a manner that the spring is permitted to rotate about an axis passing through the two anchoring points in the event of its encountering an obstruction.

To reduce the resistance to rotation of the spring, it is desirable for the anchoring points to comprise ball ended studs received in a hemispherical depressions formed by cups mounted on the end portions of the spring.

BRIEF DESCRIPTION OF DRAWINGS

The invention will now be described further, by way of example, with reference to the accompanying drawings, in which:

FIG. 1 is a diagram showing a toggle action lever of the invention, being shown in one end position in solid line and in the other end position in chain dotted lines, and FIGS. 2 to 4 show the shape of the leaf spring used as a toggle spring in FIG. 1 under different conditions.

DETAILED DESCRIPTION OF THE PREFERRED EMBODIMENT

In FIG. 1, a control lever 10 is mounted to pivot relative to a support bracket 12 about a pivot pin 14. The lever 10 is attached by a pin 16 to a Bowden cable of which the outer sheath 18 is anchored to the bracket 12. Hence, as the lever 10 moves between its two end positions, shown respectively in solid and chain dotted lines, it pulls and pushes on one end of the Bowden cable to effect the desired control. The device controlled by the lever is immaterial to the present invention, so long as it is an ON-OFF device; a typical device being a power take off (PTO) shaft in an agricultural vehicle.

To prevent the lever 10 from being moved accidentally, it is provided with a sleeve 11 which acts on a locking pin 13. The sleeve 11 must be raised manually, against the action of an internal spring, to release the locking pin before the lever can be moved out of its end position. Such a safety lock does not form an essential part of the invention and is in itself known, being used for example in motor vehicles to prevent reverse gear from being engaged unintentionally.

Instead of using a conventional coil spring, the toggle action of the lever 10 is achieved in the present invention by the use of a leaf spring 20, the end portions of which are connected to anchoring points 22 and 24 on the lever 10 and the support bracket 12, respectively.

The spring 20 is shown in FIG. 2 in its relaxed state, that is to say prior to its being deployed. Here, the central portion 20*c* is concave upwards and the end portions 20 and 20*b* are inclined towards one another. When fitted over the anchoring points 22 and 24, the spring adopts the shape shown in FIG. 3 where the central portion 20*c* is gently convex upwards and the end portions 20*a* and 20*b* are more nearly parallel to one another. In this state, the end portions 20*a* and 20*b* exert a force on the anchoring points as represented by the two arrows in FIG. 3. As the lever moves through the centre position, the spring 20 is stretched further and adopts the shape shown in FIG. 3. Here, the end portions 20*a* and 20*b* have moved apart slightly, as compared with FIG. 2, and the central portion 20*c* has become slightly more convex upwards. This deformation of the spring 20 results in an increase in the force acting on the anchoring points 22 and 24, as once again represented by two arrows.

The spring 20 at all times therefore lies in an almost straight line parallel to the line passing through the two anchoring points 22 and 24. In the illustrated preferred embodiment of the invention, the anchoring points 22 and 24 are formed as ball-ended studs which engage in hemispherical recesses formed in cups that are mounted on the end portions of the spring 20. Such a coupling of the end portions of the spring 20 not only reduces resistance to flexing of the spring as the lever 10 moves between its two end positions but allows the entire spring 20 to rotate about an axis passing through the two anchoring points 22 and 24. Hence, if the edge of the spring 20 should encounter an obstruction, such as represented by plates 30 and 32 in FIG.

1, the spring 20 can rotate from its position shown in solid lines, which is to the left of the anchoring points 22 and 24, to the position shown in chain dotted lines where it lies to the right of the anchoring points. This ability of the spring to move around in this manner adds to the versatility of the toggle action lever.

It will thus be seen from the foregoing description that the invention allows a toggle spring to be used in a confined space and can even tolerate obstructions in its path of movement.

Having thus described the invention, what is claimed is:

1. A lever mounted on a support for pivotal movement between two end positions and a toggle spring connected at its opposite ends to the lever and the support and acting to bias the lever away from a centre position of unstable equilibrium toward the two end positions, characterized in that the toggle spring is a leaf spring, wherein the leaf spring has two end portions for coupling the leaf spring to anchoring points on the lever and the support, respectively, and a central portion extending between the two end portions, the central portion of the leaf spring having a length substantially equal to the distance between the anchoring points.

2. A lever mounted on a support for pivotal movement between two end positions and a toggle spring connected at its opposite ends to the lever and the support and acting to bias the lever away form a centre position of unstable equilibrium toward the two end positions, characterized in that the toggle spring is a leaf spring, wherein the end portions of the spring are coupled to the anchoring points in such a manner that the spring is permitted to rotate about an axis passing through the two anchoring points in the event of its encountering an obstruction.

3. An action lever as claimed in claim 2, wherein the anchoring points comprise ball ended studs received in a hemispherical depressions formed by cups mounted on the end portions of the leaf spring.

* * * * *